US009506731B2

(12) United States Patent
Imhoff

(10) Patent No.: US 9,506,731 B2
(45) Date of Patent: Nov. 29, 2016

(54) MULTIPLE PROJECTILE FIXED CARTRIDGE

(71) Applicant: RA BRANDS, L.L.C., Madison, NC (US)

(72) Inventor: Jason W. Imhoff, North Little Rock, AR (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 13/815,670

(22) Filed: Mar. 14, 2013

(65) Prior Publication Data

US 2014/0261042 A1 Sep. 18, 2014

(51) Int. Cl.
*F42B 5/03* (2006.01)
*F42B 5/067* (2006.01)

(52) U.S. Cl.
CPC *F42B 5/03* (2013.01); *F42B 5/067* (2013.01)

(58) Field of Classification Search
CPC ..... F42B 5/03; F42B 5/035; F42B 5/00; F42B 5/02; F42B 5/067; F42B 5/073
USPC ..... 102/438, 443, 446, 454, 520, 521
See application file for complete search history.

(56) References Cited

U.S. PATENT DOCUMENTS

| | | | | |
|---|---|---|---|---|
| 703,839 | A * | 7/1902 | Scott | 102/438 |
| 703,840 | A * | 7/1902 | Scott | 102/438 |
| 1,376,530 | A * | 5/1921 | Greener | 102/438 |
| 2,835,198 | A * | 5/1958 | Brombacher | 102/438 |
| 3,169,333 | A | 2/1965 | Scanlon, Jr. | |
| 3,412,681 | A | 11/1968 | Schirneker | |
| 6,138,395 | A | 10/2000 | ODwyer | |
| 7,210,412 | B2 | 5/2007 | ODwyer | |
| 7,464,649 | B2 | 12/2008 | Bishop et al. | |
| 7,475,635 | B2 | 1/2009 | Bambach | |
| 7,475,636 | B2 | 1/2009 | ODwyer et al. | |
| 7,707,941 | B2 | 5/2010 | Bishop et al. | |
| 7,984,675 | B2 | 7/2011 | ODwyer | |
| 8,109,212 | B2 | 2/2012 | ODwyer | |
| 8,307,768 | B2 | 11/2012 | Cziglenyi | |
| 8,807,040 | B2 * | 8/2014 | Menefee, III | 102/460 |
| 2009/0241796 | A1 | 10/2009 | Bambach | |
| 2012/0234198 | A1 | 9/2012 | Carmel | |
| 2013/0014664 | A1 | 1/2013 | Padgett | |

FOREIGN PATENT DOCUMENTS

| | | | |
|---|---|---|---|
| DE | 1428655 | A * | 12/1968 |
| DE | 3834925 | A1 | 4/1990 |

OTHER PUBLICATIONS

"Multiple Projectile Technology", http://www.lehighdefense.com/index.php/our-technology/multiple-projectile-technology (accessed Feb. 11, 2013).

(Continued)

*Primary Examiner* — James S Bergin
(74) *Attorney, Agent, or Firm* — Womble Carlyle Sandridge & Rice, LLP

(57) ABSTRACT

A multiple projectile fixed cartridge includes a casing, a retention insert arranged in the casing, and a plurality of projectiles arranged proximate the retention insert. The retention insert is configured to align and support at least a first projectile of the plurality of projectiles, and the casing is configured to align and support a second projectile of the plurality of projectiles.

15 Claims, 11 Drawing Sheets

(56) References Cited

OTHER PUBLICATIONS

Premier Core-Lokt Ultra Bonded: The New Standard of Accuracy in Bonded Hunting Bullets; Remington 2008 Catalog: Firearms, Ammunition & Accessories; Remington Arms Company, Inc.
Premier Accutip: Precisely the Big-Game Bullet of Your Dreams; Remington 2008 Catalog: Firearms, Ammunition & Accessories; Remington Arms Company, Inc., Madison, NC; p. 62.
Remington Core-Lokt: The World's Best-Selling Centerfire Ammunition; Remington 2008 Catalog: Firearms, Ammunition & Accessories; Remington Arms Company, Inc., Madison, NC; p. 66.
Remington Rifle Cartridges; Remington 2008 Catalog: Firearms, Ammunition & Accessories; Remington Arms Company, Inc., Madison, North Carolina; p. 68.
Managed-Recoil Rifle Cartridges; Remington 2008 Catalog: Firearms, Ammunition & Accessories; Remington Arms Company, Inc., Madison, North Carolina; p. 70.
Pistol & Revolver Cartridges; Remington 2008 Catalog: Firearms, Ammunition & Accessories; Remington Arms Company, Inc., Madison, North Carolina; p. 72.
Remington Reloading Components; Remington 2008 Catalog: Firearms, Ammunition & Accessories; Remington Arms Company, Inc., Madison, North Carolina; p. 75.

* cited by examiner

MULTIPLE PROJECTILE FIXED CARTRIDGE

BACKGROUND OF THE DISCLOSURE 1.0 Field of the Disclosure

This disclosure relates generally to cartridges for ammunition. In particular, exemplary embodiments are directed to multiple projectile cartridges having an insert arranged within the cartridge casing which includes an interior cavity for supporting one or more projectiles.

2.0 Related Art

Multiple projectile fixed cartridge loads are conventionally referred to as duplex (e.g., two projectiles) or triplex (e.g., three projectiles) loads. Such duplex and triplex loads, when used in a bottleneck casing (e.g., a centerfire rifle casing), can have a plurality of shortcomings. For example, some conventional multi-projectile cartridges have lacked support for one or more projectiles within the casing, which can create problems in maintaining proper projectile alignment, such that accuracy and precision of each of the projectiles may be reduced.

Internalized support structures have been developed for multiple projectile loads generally through the use of recesses formed along a central axis of each projectile. In addition to providing a nested fit between successive rounds, the recesses further may be configured to support a rod, pin, or other alignment device which engages the plurality of projectiles and maintains proper alignment therebetween. However, the use of such tight mating recesses and additional support structures can significantly increase the complexity and cost of manufacture of the projectiles. For example, imperfection in the concentricity or shape of the recesses results in a static and dynamic mass imbalance of individual projectiles. Mass imbalance localized near the rear of a projectile can be particularly harmful to accuracy of the rounds by causing compounding effects on projectile dispersion. Furthermore, due to inherent variations in manufacturing tolerances it is very difficult to form heel cavities or recesses that do not result in some level of mass imbalance.

Assembly of conventional multi-projectile cartridges also can be complicated due to the accuracy necessary in alignment of the multiple projectiles. Oftentimes the projectiles are inserted within a casing as a single unit in a single step, thus requiring substantially precise alignment prior to insertion within the casing. Thereafter, upon firing, presentation of expanding combustion gases to the different projectiles can lead to issues in the accuracy of such projectiles. For example, conventional duplex and triplex loads can lack control in presenting expanding combustion gases to a volume of space between two or more projectiles, thus creating further inaccuracy due to differences in gas pressures acting upon each projectile of the multiple projectiles.

Further complications can arise in the use of multiple projectiles for subsonic loads (e.g., loads presenting a muzzle velocity below the speed of sound). Most conventional weapon systems typically are optimized for the use of supersonic ammunition (e.g., loads presenting a muzzle velocity above the speed of sound). When use of subsonic ammunition is attempted in such weapon systems, malfunctions can occur due to the energy generated by the reduced velocity load being insufficient to reliably cycle the weapon. Typical design changes to counter this deficiency are increasing projectile velocity, increasing propellant mass, and/or increasing projectile mass. Each option has traditionally had substantial shortcomings. Increasing projectile velocity in subsonic loads is by definition constrained. Increasing propellant mass for the same projectile velocity is wasteful/costly. Increasing the mass of a single projectile for any given caliber requires either lengthening the projectile, which typically hinders accuracy due to instability, or constructing the projectile of higher density materials, which usually results in an increased cost.

Accordingly, a need exists for increased accuracy, decreased production costs, and improved weapons functionality in multiple projectile fixed cartridge designs.

SUMMARY OF THE INVENTION

According to an aspect of the disclosure, a multiple projectile fixed cartridge is described. The cartridge includes a casing, a retention insert arranged in the casing, and a plurality of projectiles arranged proximate the retention insert. The retention insert generally is configured to align and support at least a first projectile of the plurality of projectiles, and the casing can be configured to align and support an additional one, e.g., second projectile, of the plurality of projectiles.

According to an aspect of the disclosure, a multiple projectile fixed cartridge is described. The cartridge includes a casing having a primer receiving portion, a projectile receiving portion, and an interior cavity or chamber. The cartridge further includes a retention insert arranged in the interior cavity. The retention insert generally is configured to engage an interior surface of the casing and prevent movement relative thereto. The cartridge further includes a plurality of projectiles arranged within the casing. The retention insert is configured to align and support at least one or more projectiles of the plurality of projectiles, while the casing can be configured to align and support at least one projectile of the plurality of projectiles such that a central axis of the casing, a central axis of the projectile(s) supported by the insert, and a central axis of the at least one projectile supported by the casing are substantially collinear.

According to yet another aspect of the disclosure, a retention insert of a multiple projectile fixed cartridge is described. The retention insert can include a frustoconical portion configured to engage an interior surface of a cartridge casing in a manner so as to substantially restrain longitudinal movement of the retention insert relative to the cartridge casing, a cylindrical portion proximate frustoconical portion, and a cavity formed in the cylindrical portion configured to align and support a plurality of projectiles. The cavity can have a geometry configured to support a portion of an exterior shape of the plurality of projectiles.

Additional features, advantages, and embodiments of the disclosure may be set forth or apparent from consideration of the following detailed description, drawings, and claims. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the invention, are incorporated in and constitute a part of this specification, illustrate embodiments of the invention, and together with the detailed description, serve to explain the principles of the invention. No attempt is made to show structural details of the invention in more detail than may be necessary for a fundamental understanding of the invention and the various ways in which it may be practiced. In the drawings.

DETAILED DESCRIPTION OF THE DISCLOSURE

Figure 1A:
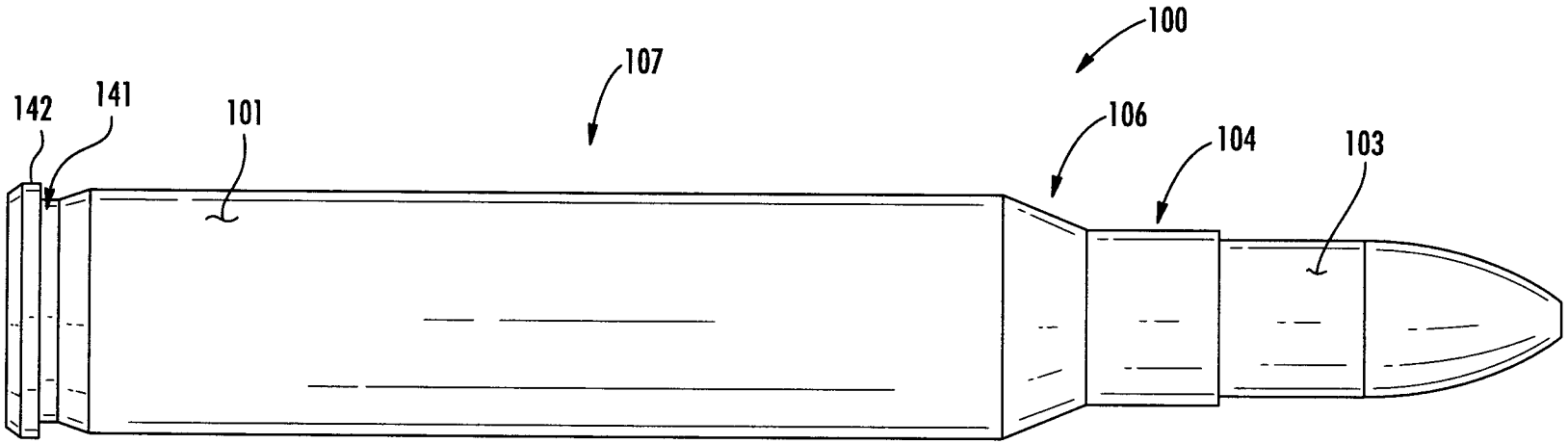
FIG. 1A is an elevation view of a multiple projectile fixed cartridge, according to one embodiment of the disclosure.

The aspects of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals represent similar parts throughout the several views of the drawings.

It is understood that the invention is not limited to the particular methodology, devices, apparatus, materials, applications, etc., described herein, as these may vary. It is also to be understood that the terminology used herein is used for the purpose of describing particular embodiments only, and is not intended to limit the scope of the invention. It must be noted that as used herein and in the appended claims, the singular forms "a," "an," and "the" include plural reference unless the context clearly dictates otherwise. Unless defined otherwise, all technical and scientific terms used herein have the same meanings as commonly understood by one of ordinary skill in the art to which this invention belongs.

As used herein, a fixed cartridge may refer to a round of ammunition for use in a weapon, where a projectile, propellant, and primer are fixedly arranged in a casing for loading and discharging through the weapon. As used herein, a multiple projectile fixed cartridge may refer to a round of ammunition for use in a weapon, where more than one projectile, one or more propellant(s), and a primer are fixedly arranged in a casing for loading and discharging through the weapon. The more than one projectile may include projectiles of differing weights, compositions, lengths, and/or shapes, or may include projectiles of substantially similar structural composition. The one or more propellant(s) may include at least one charge of a propellant chemistry arranged in the casing and configured to discharge in response to activation by the primer, thereby propelling the more than one projectile through the barrel of the weapon. The multiple projectile fixed cartridge referred to herein may be implemented in many different manners, and such different manners are considered to be within the scope of exemplary embodiments of the present invention and the many drawings presented herein.

Referring to the many drawings, FIGS. 1-8 generally illustrate various embodiments of the invention directed to a multiple projectile fixed cartridge including a retention insert arranged in a casing. Generally, the casing may be arranged for use in a plurality of firearms and weapons systems, including, but not limited to, autoloading guns, rifles, shotguns and other long guns, and handguns. The retention insert may be configured to support at least one projectile of a plurality of projectiles, while the casing may be configured to support a second projectile of the plurality of projectiles.

While conventional fixed cartridges are limited to a single projectile of a particular configuration, the retention insert allows a second different or similar projectile to be arranged in a multiple projectile fixed cartridge. Therefore, a total mass of projectiles discharged in the multiple projectile fixed cartridges described herein may be greater than conventional cartridges, and thus, associated inertia is also larger, and therefore, a reduced velocity of discharge is achievable while maintaining appropriate recoil forces necessary to fully cycle a weapon. In this manner, a variety of different projectile configurations including subsonic configurations may be extensible to any desired implementation of exemplary embodiments of the present invention, without detracting from the functionality of a weapon, and while allowing multiple projectiles to be presented to a target. Hereinafter, a more detailed explanation of possible configurations of multiple projectile fixed cartridge designs is provided with reference to the many drawings.

Figure 1B:
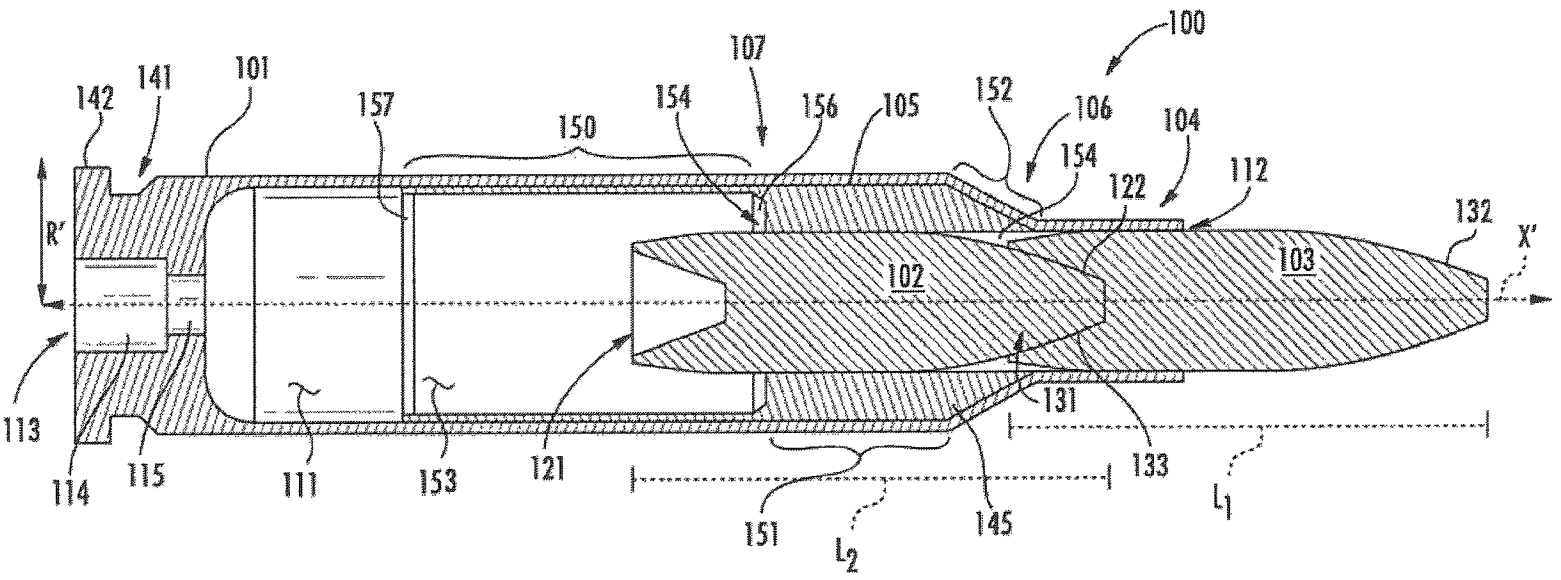
FIG. 1B is a cross section view of the multiple projectile fixed cartridge of FIG. 1A.
Figure 1C:
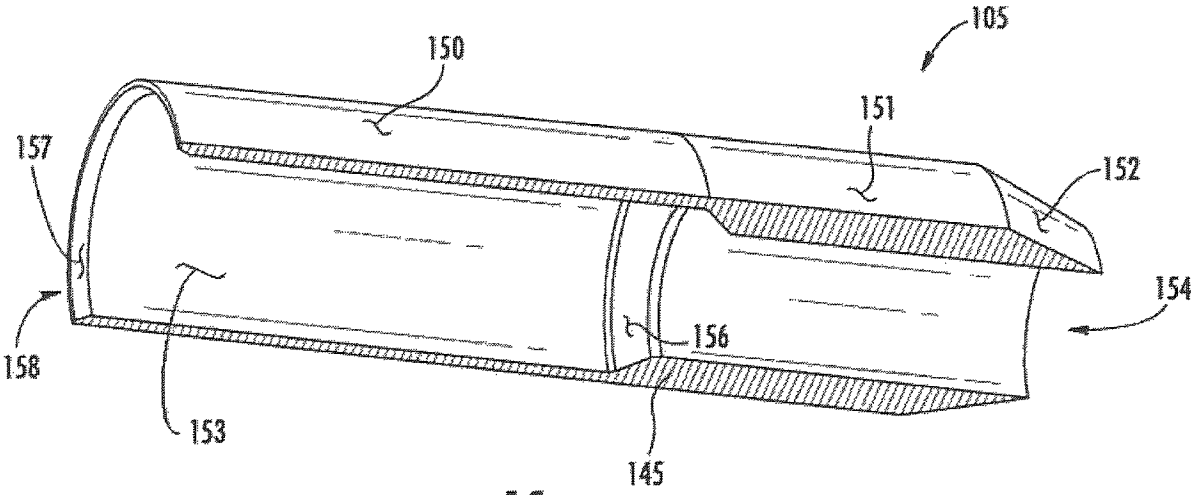
FIG. 1C is a perspective cross section view of a retention insert of the multiple projectile fixed cartridge of FIGS. 1A-1B.

FIGS. 1A-1C illustrate several views of a multiple projectile fixed cartridge 100 and an associated retention insert 105, according to embodiments of the disclosure. As illustrated, the cartridge 100 generally includes a casing 101 and at least two projectiles 102, 103 arranged therein. The casing 101 can be a cylindrical casing having a central axis X' and a radial axis R'. It will be understood that while the cartridge 100 is generally shown as a center-fire type cartridge with a bottle-necked configuration, other types or configurations of cartridges also can be used.

As shown in FIGS. 1A-1B, the casing 101 can include a neck portion 104, shoulder portion 106 (here shown as having a tapered or bottleneck configuration) arranged proximate the neck portion 104, and cylindrical body 107 arranged proximate the shoulder portion 106. The neck portion 104 may be sized, crimped, or otherwise constrained about the projectile 103. In this manner, the neck portion 104 can support the projectile 103 so as to maintain a collinear alignment of a central axis of the projectile 103 along the central axis X' of the casing 101. The neck portion 104, shoulder portion 106, and cylindrical body 107 also may be otherwise shaped or arranged without departing from the scope of this disclosure.

The cartridge 100 further includes a retention insert 105 arranged therein and configured to support and align projectile 102. In this manner, the insert 105 supports the projectile 102 and maintains a collinear alignment of a central axis of the projectile 102, the central axis of the projectile 103, and the central axis X'. Generally, the retention insert 105 is configured to restrain radial movement of the projectile 102 relative to the casing 101 and the projectile 103.

As further illustrated in FIG. 1B, the casing 101 may include an annular recess 141 arranged in a rearward section of the cylindrical body 107 and an associated rim 142. The annular recess 141 and rim 142 may be configured to allow automatic expulsion of a spent casing. 101 or a fully loaded casing 101 when cycling a weapon. The recess 141 and rim 142 may be omitted or otherwise shaped or arranged without departing from the scope of this disclosure.

According to one embodiment, such as shown in FIG. 1B, the projectile 102 may be a generally cylindrical projectile having a rear portion 121 and a front, portion 122. The projectile 103 may be a generally cylindrical projectile having a rear portion 131 and a front portion 132. The rear portion 131 of the projectile 103 also may include a cavity or recess 133 of otherwise can be shaped or configured to receive and support the front portion 122 of the first or rearward projectile 102. The rear portion 121 of projectile 102 may be similarly-shaped or configured as projectile 103 so as to facilitate receipt of an additional projectile arranged rearward therefrom. Thus, as shown in FIG. 1B, the projectiles 102, 103 may be mounted/located along the casing 101 in a generally nested configuration. The projectile 103 may have a total length L1, and the projectile 102 may have a total length L2. The length L1 may be greater than, shorter than, or substantially equal to the length L2. The projectiles 102, 103 also may be otherwise shaped or configured without departing from the scope of this disclosure.

The neck portion 104 of the casing 101 shown in FIGS. 1A-1B generally defines a projectile receiving portion 112 configured to receive the projectiles 102, 103, and the insert 105, and a primer receiving portion 113 configured to receive a primer 114. The casing further includes a flash hole 115 configured to transmit energy from the primer 114 into a central chamber or cavity 111 of the casing 101. The central cavity 111 of the casing 101 generally is a substantially hollow cavity configured to support a propellant charge. The primer 114, flash hole 115, and central cavity 111 may be otherwise shaped or arranged without departing from the scope of this disclosure.

As illustrated in FIGS. 1B-5, the retention insert 105 is arranged within the cavity/chamber 111 of the casing 101 and can abut against the shoulder portion 106. As a result, the retention insert 105 can engage an interior surface of the casing, such as along the neck portion 104 and prevent longitudinal movement relative thereto. For example, as shown in FIG. 1C, the retention insert 105 may include an elongated body 145 having one or more sections including a frustoconical section 152 shaped to engage and/or project along the shoulder portion 106 from an interior of the casing 101. The body 145 of the insert 105 may further include a first or forward tapered cylindrical section 151 proximate the frustoconical section 152, arranged to align and support the projectile 102 within a cavity 154 formed within the cylindrical portion 151. The cavity 154 may have a geometry that is supportive, or generally supportive, of the exterior dimensions of the projectile 102. As further illustrated, the projectile 102 is generally supported in a radial direction within the tapered cylindrical portion 151.

The body 145 of the insert 105 further may include a rearwardly extending skirted or second cylindrical section 150. The section 150 may be a hollow section and/or may support a secondary supportive insert. The section 150 can include an outer sidewall 153 with a first or forward beveled surface 156 proximate the tapered cylindrical section 151 of the body 145 and a second or rearward surface 157 proximate a distal end 158 of the section 150 and which also can be formed as a beveled surface. The beveled surfaces 156, 157 of the section 150 are arranged to receive and guide energy from expanding combustion gases formed from ignition of the propellant in cavity 111 to the projectiles 102, 103 and thereby discharge the projectiles 102, 103 out of the casing 101 and along the barrel of a firearm.

According to one embodiment, the retention insert 105 generally is formed of a plastic material, including but not limited to, for example, a thermoplastic, acrylic, polyester, silicone, polyurethane, polymer or any other suitable plastic material. According to another embodiment, the retention insert 105 is formed of a metallic material, metal, or metal alloy, including but not limited to aluminum, brass, steel, or any other suitable metal or metallic material. According to other embodiments, the retention insert may be formed of any other suitable material, including those not listed specifically above. The retention insert 105, and associated features 150, 151, 152, 153, 154, 156, 157, 158 thereof may be otherwise shaped or arranged without departing from the scope of this disclosure.

As described above, a multiple projectile fixed cartridge may include a casing, a retention insert arranged in the casing, and a plurality of projectiles arranged proximate and within the retention insert or casing, wherein the retention insert is configured to align and support at least a first projectile (e.g., 102) of the plurality of projectiles, and the casing is configured to align and support a second projectile (e.g., 103) of the plurality of projectiles. Additional configurations of projectiles (e.g., three or more) also can be used.

The projectiles may be arranged to be supportive of one another through a rear section (e.g., 131) being configured to receive and support a front portion (e.g., 122) of another projectile. However, the same may be varied in many ways. For example, other arrangements of projectiles lacking discrete supportive rear sections may be applicable to some embodiments, such as illustrated in FIG. 2.

Figure 2:
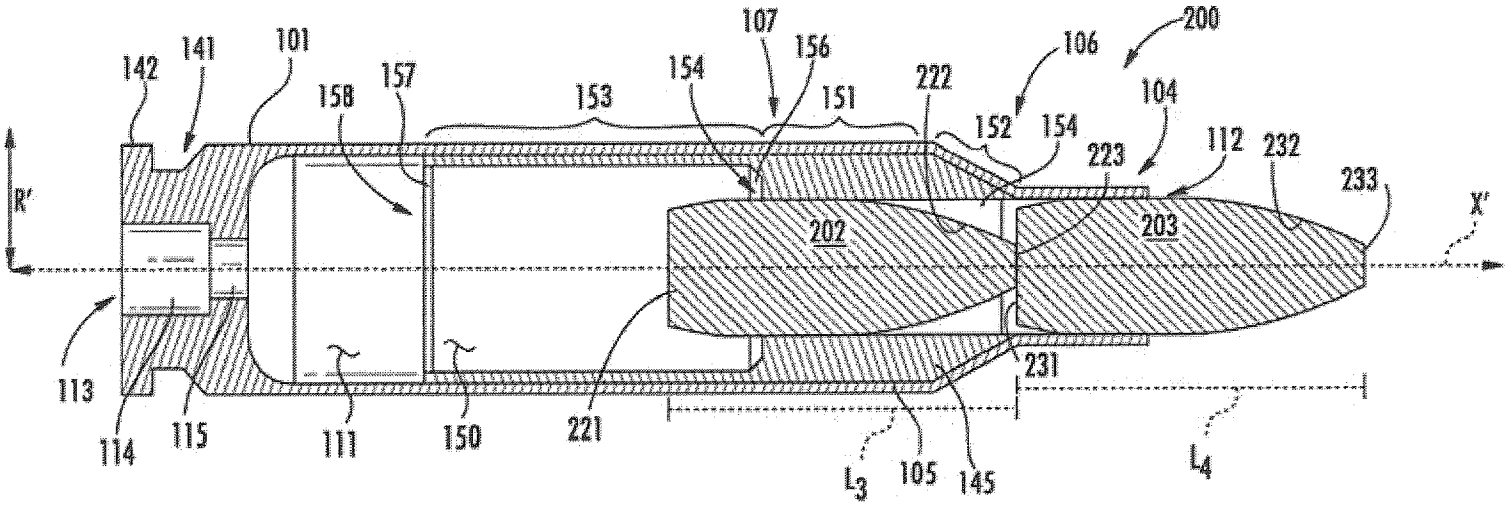
FIG. 2 is a cross section view of a multiple projectile fixed cartridge, according to another embodiment of the disclosure.

FIG. 2 is a cross section view of a multiple projectile fixed cartridge 200, according to an additional embodiment of the disclosure. The cartridge 200 may include some substantially similar components as the cartridge 100, with like reference numerals representing like elements. As shown, the cartridge 200 includes a casing 101 with projectiles 202, 203 arranged therein. The casing 101 is a cylindrical casing having a central axis X' and a radial axis R'. The neck portion 104 may be sized, crimped, or otherwise constrained about the projectile 203. In this manner, the neck portion 104 supports the projectile 203 and maintains a collinear alignment of a central axis of the projectile 203 and the central axis X'. The cartridge 200 further includes the retention insert 105 arranged therein and configured to support and align projectile 202. In this manner, the insert 105 supports the projectile 202 and maintains a collinear alignment of a central axis of the projectile 202, the central axis of the projectile 203, and the central axis X'.

According to one embodiment, the projectile 202 may be a generally cylindrical projectile having a generally flat rear portion 221, a front portion 222, and a generally flat nose section 223. The projectile 203 may be a generally cylindrical projectile having a generally flat rear portion 231, a front portion 232, and a generally flat nose section 233. The generally flat rear portion 231 may be abutted against the nose section 223. Thus, the projectiles 202, 203 may be in an end-to-end abutted configuration. The projectile 202 may have a total length L3, and the projectile 203 may have a total length L4. The length L3 may be greater than, shorter than, or substantially equal to the length L4. The projectiles 202, 203 may be otherwise shaped or configured without departing from the scope of this disclosure.

As illustrated, the retention insert 105 is arranged within the cavity 111 and abutted against the shoulder portion 106. The retention insert 105 can include the elongated body 145 having the frustoconical section 152 shaped to engage the shoulder portion 106 of the casing 101. The insert body 145 further may include the tapered cylindrical portion 151 proximate the frustoconical portion 152, arranged to align and support the projectile 202 within a cavity 154 formed within the forward or first tapered cylindrical portion 151. The cavity 154 may have a geometry that is supportive, or generally supportive, of the exterior dimensions of the projectile 202. As further illustrated, the projectile 202 is generally supported in a radial direction within the tapered cylindrical portion 151 substantially aligned with the projectile 203 along the longitudinal axis X'. The insert body 145 may further include the formation 150, and the formation 150 may function to discharge and propel the projectiles 202, 203 as described above. The retention insert 105, and associated features 150, 151, 152, 153, 154, 156, 157, 158 thereof may be otherwise shaped or arranged without departing from the scope of this disclosure.

As described above, the multiple projectile fixed cartridge may include a casing, a retention insert arranged in the casing, and a plurality of projectiles arranged proximate and within the retention insert or casing, wherein the retention insert is configured to align and support at least a first projectile (e.g., 202) of the plurality of projectiles, and the casing is configured to align and support a second projectile (e.g., 203) of the plurality of projectiles. The projectiles may be arranged to be supportive of one another through a flattened rear section (e.g., 231) configured to abut a nose section (e.g., 223) of another projectile, and additional projectiles also can be used.

As further described above, with reference to both FIGS. 1 and 2, expanding combustion gases from the propellant will propel the first projectile (e.g., 102, 202) against the second projectile (e.g., 103, 203) and thereby propel both projectiles forward. However, such propulsion of the projectiles also may be varied. For example, other arrangements of the projectiles and the insert of the present invention, configured to enhance direction and control of expanding combustion gases also may be applicable to some embodiments, as illustrated in FIG. 3.

Figure 3:
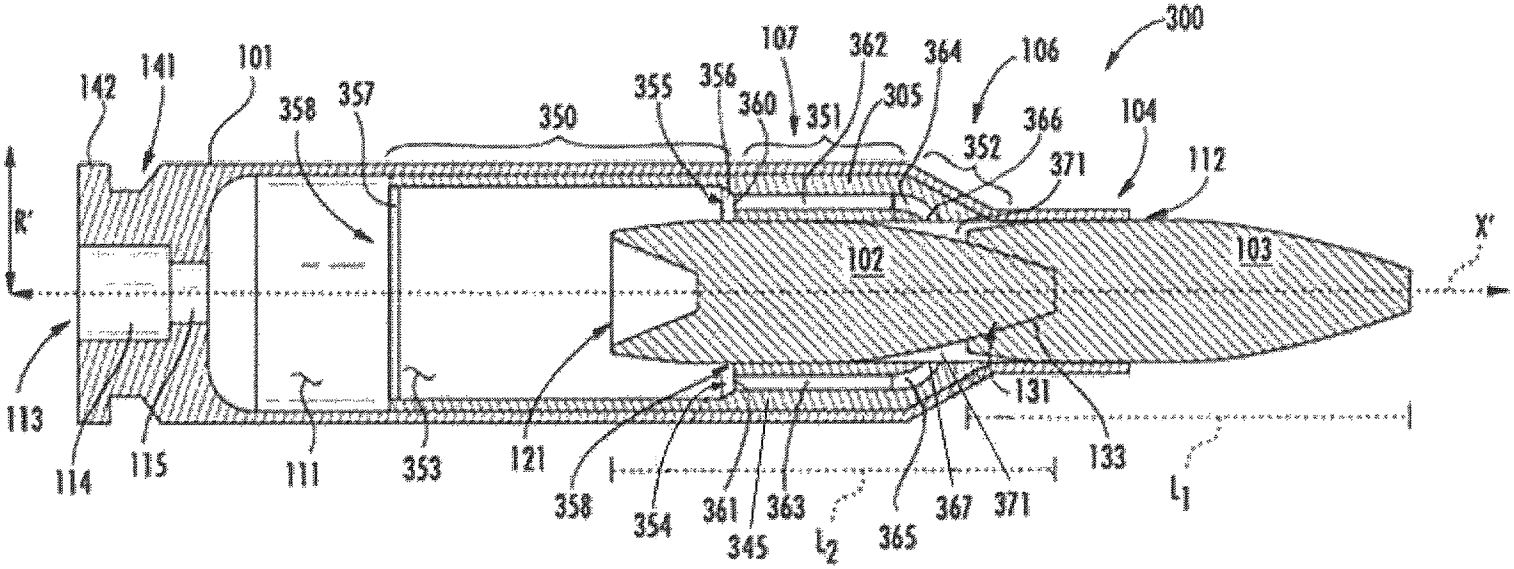
FIG. 3 is a cross section view of a multiple projectile fixed cartridge, according to a further embodiment of the disclosure.

FIG. 3 is a cross section view of a multiple projectile fixed cartridge 300, according to a further embodiment of the disclosure. The cartridge 300 may include some substantially similar components as the cartridges 100, 200, with like reference numerals representing like elements. As shown, the cartridge 300 includes the casing 101 and projectiles 102, 103 arranged therein. The casing 101 is a cylindrical casing having a central axis X' and a radial axis R'. The neck portion 104 may be sized, crimped, or otherwise constrained about the projectile 103 as described above. The cartridge 300 further includes a retention insert 305 arranged therein and configured to support and align projectile 102. In this manner, the insert 305 supports the projectile 102 and maintains a collinear alignment of a central axis of the projectile 102, the central axis of the projectile 103, and the central axis X'.

As illustrated, the retention insert 305 is arranged within the cavity/chamber 111 of the casing 101 and can abut against the shoulder portion 106. As a result, the retention insert 305 can engage an interior surface of the casing, such as along the neck portion 104 and prevent longitudinal movement relative thereto. For example, as shown in FIG. 3, the retention insert 305 may include an elongated body 345 having one or more sections including a frustoconical section 352 shaped to engage and/or project along the shoulder portion 106 from an interior of the casing 101. The body 345 of the insert 305 may further include a first or forward tapered cylindrical section 351 proximate the frustoconical section 352, arranged to align and support the projectile 102 within a cavity 358 formed within the tapered cylindrical portion 351. The cavity 358 may have a geometry that is supportive, or generally supportive, of the exterior dimensions of the projectile 102. As further illustrated, the projectile 102 is generally supported in a radial direction within the cylindrical portion 351.

The body 345 of the insert 305 further may include a rearwardly extending skirted or second cylindrical section 350. The section 350 may be a hollow section and/or may support a secondary supportive insert. The section 350 can include an outer sidewall 353 with a first or forward beveled surface 356 proximate the tapered cylindrical section 351 of the body 345 and a second or rearward surface 357 proximate a distal end 358 of the section 350 and which also can be formed as a beveled surface. The beveled surfaces 356, 357 of the section 350 are arranged to receive and guide energy from expanding combustion gases formed from ignition of the propellant in cavity 111 to the projectiles 102, 103 and thereby aid to discharge the projectiles 102, 103 out of the casing 101 and along the barrel of a firearm.

As further illustrated, the retention insert 305 may include combustion ports 354, 355 arranged to transmit expanding combustion gases formed from ignition of the propellant arranged in cavity 111 to a space 371 between projectiles 102, 103.

The combustion port 354 may include an inlet 361 arranged on the first beveled surface 356, a longitudinal section 363 in communication with the inlet 361, a curved or angled section 365 in communication with the longitudinal section 363, and an exhaust 367 in communication with the curved section 365 and the space 371. The longitudinal section 363 may extend in a longitudinal direction from the inlet 361 to the curved section 365. The curved section 365 may curve radially towards the exhaust 367. Thus, the inlet 361 may receive expanding combustion gases, the longitudinal section 363 may transmit the received gases, and the curved section 365 may direct the transmitted gases to the exhaust 367 such that the expanding gases may at least partially fill the space 371.

The combustion port 355 may include an inlet 360 also arranged on the first beveled surface 356, a longitudinal section 362 in communication with the inlet 360, a curved or angled section 364 in communication with the longitudinal section 362, and an exhaust 366 in communication with the curved section 364 and the space 371. The longitudinal section 362 may extend in a longitudinal direction from the inlet 360 to the curved section 364. The curved section 364 may curve radially towards the exhaust 366. Thus, the inlet 360 may receive expanding combustion gases, the longitudinal section 362 may transmit the received gases, and the curved section 364 may direct the transmitted gases to the exhaust 366 such that the expanding gases may at least partially fill the space 371.

The energy of the expanding combustion gases transmitted through the formation 350 and the ports 354, 355 may thereby discharge the projectiles 102, 103 out of the projectile receiving portion 112 and into a weapon which further directs the projectiles 102, 103. The retention insert 305 may be formed of the same or somewhat similar materials as those listed above with reference to the insert 105. The retention insert 305, and associated features 350, 351, 352, 353, 354, 355, 356, 357, 358, 360, 361, 362, 363, 364, 365, 366, 367, may be otherwise shaped or arranged without departing from the scope of this disclosure.

As described above, the multiple projectile fixed cartridge may include a casing, a retention insert arranged in the casing, and a plurality of projectiles arranged proximate and within the retention insert or casing, wherein the retention insert is configured to align and support at least a first projectile (e.g., 102) of the plurality of projectiles, and the casing is configured to align and support a second projectile (e.g., 103) of the plurality of projectiles. The retention insert may include one or more ports (e.g., 354, 355) arranged to receive, transmit, route, and direct expanding combustion gases to individual projectiles (e.g., 103) or a space between one or more projectiles (e.g.; 371).

Although described with reference to FIG. 3 as applying to projectiles shaped as the generally cylindrical projectiles 102, 103, the same may also be varied. For example, other arrangements of projectiles may be applicable to the insert 305, as illustrated in FIG. 4.

Figure 4:
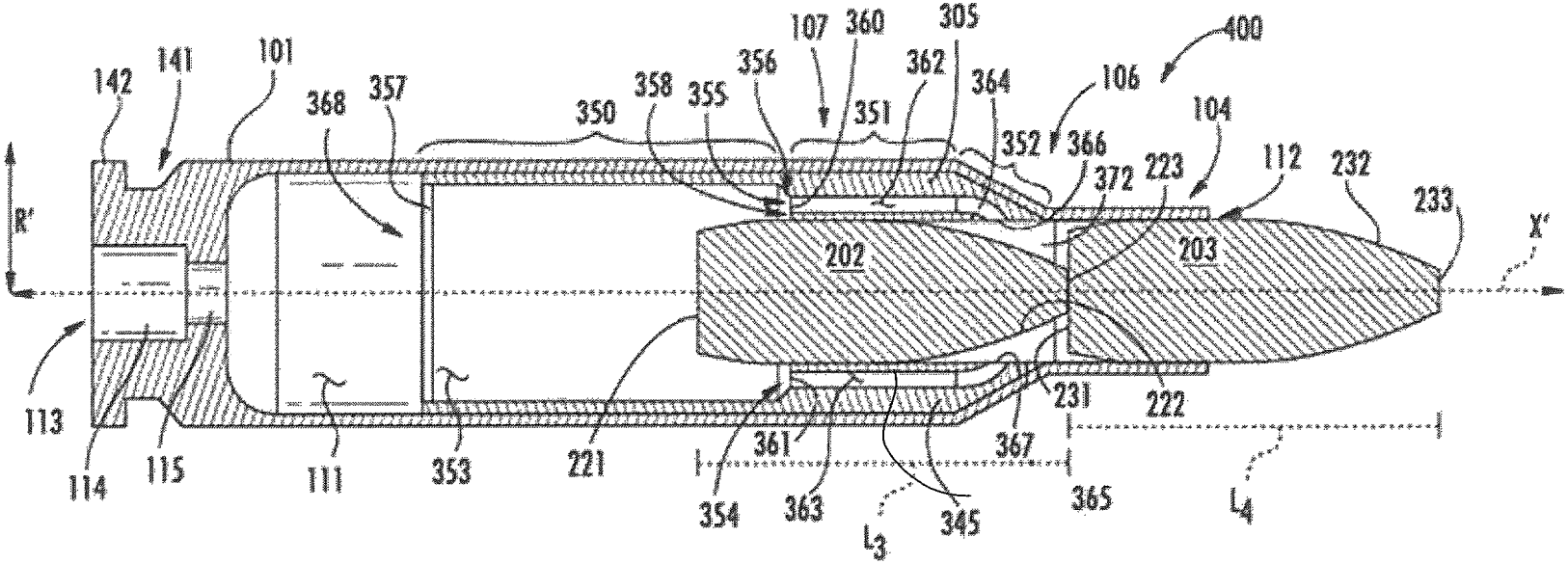
FIG. 4 is a cross section view of a multiple projectile fixed cartridge, according to yet another embodiment of the disclosure.

FIG. 4 is a cross section view of a multiple projectile fixed cartridge 400, according to yet another embodiment of the disclosure. The cartridge 400 may include some substantially similar components as the cartridges 100, 200, 300, with like reference numerals representing like elements. As shown, the cartridge 400 includes the casing 101 and projectiles 202, 203 arranged therein. The casing 101 is a cylindrical casing having a central axis X' and a radial axis R'. The neck portion 104 may be sized, crimped, or otherwise constrained about the projectile 203 as described above. The cartridge 400 further includes a retention insert 305 arranged therein and configured to support and align projectile 202. In this manner, the insert 305 supports the projectile 202 and maintains a collinear alignment of a central axis of the projectile 202, the central axis of the projectile 203, and the central axis X'.

As illustrated, the retention insert 305 is arranged within the cavity 111 and abutted against the shoulder portion 106. For example, the retention insert body 345 may include a frustoconical section 352 shaped to engage the shoulder portion 106 of the casing 101. The insert body 345 further may include a tapered cylindrical portion 351 proximate the frustoconical portion 352, arranged to align and support the projectile 202 within a cavity 358 formed within the tapered cylindrical portion 351. The cavity 358 may have a geometry that is supportive, or generally supportive, of the exterior dimensions of the projectile 202. As further illustrated, the projectile 202 is generally supported in a radial direction within the tapered cylindrical portion 351 substantially aligned with the projectile 203 along the longitudinal axis X'. The formation 350 may function to discharge and propel the projectiles 202, 203 as described above.

As further illustrated, the retention insert 305 may include the combustion ports 354, 355 arranged to transmit expanding combustion gases formed from ignition of the propellant in cavity 111 to a space 372 between projectiles 202, 203. The combustion port 354, 355 may include the same or substantially similar sections as described above, which are arranged to receive and direct energy of expanding combustion gases as described above. The energy of the expanding combustion gases transmitted through the formation 350 and the ports 354, 355 may thereby discharge the projectiles 202, 203 out of the projectile receiving portion 112 and into a weapon which further directs the projectiles 202, 203. The retention insert 305, and associated features 350, 351, 352, 353, 354, 355, 356, 357, 358, 360, 361, 362, 363, 364, 365, 366, 367, may be otherwise shaped or arranged without departing from the scope of this disclosure.

As described above, the multiple projectile fixed cartridge may include a casing, a retention insert arranged in the casing, and a plurality of projectiles arranged proximate and within the retention insert or casing, wherein the retention insert is configured to align and support at least a first projectile (e.g., 202) of the plurality of projectiles, and the casing is configured to align and support a second projectile (e.g., 203) of the plurality of projectiles. The retention insert may include one or more ports (e.g., 354, 355) arranged to receive, transmit, route, and direct expanding combustion gases to individual projectiles (e.g., 203) or a space between one or more projectiles (e.g., 372).

Although described with reference to FIGS. 1-4 as applying to at least two projectiles (e.g., 101, 102 & 202, 203), the same may also be varied. For example, other arrangements and numbers of projectiles may be applicable to embodiments, as illustrated in FIGS. 5-7.

Figure 5:
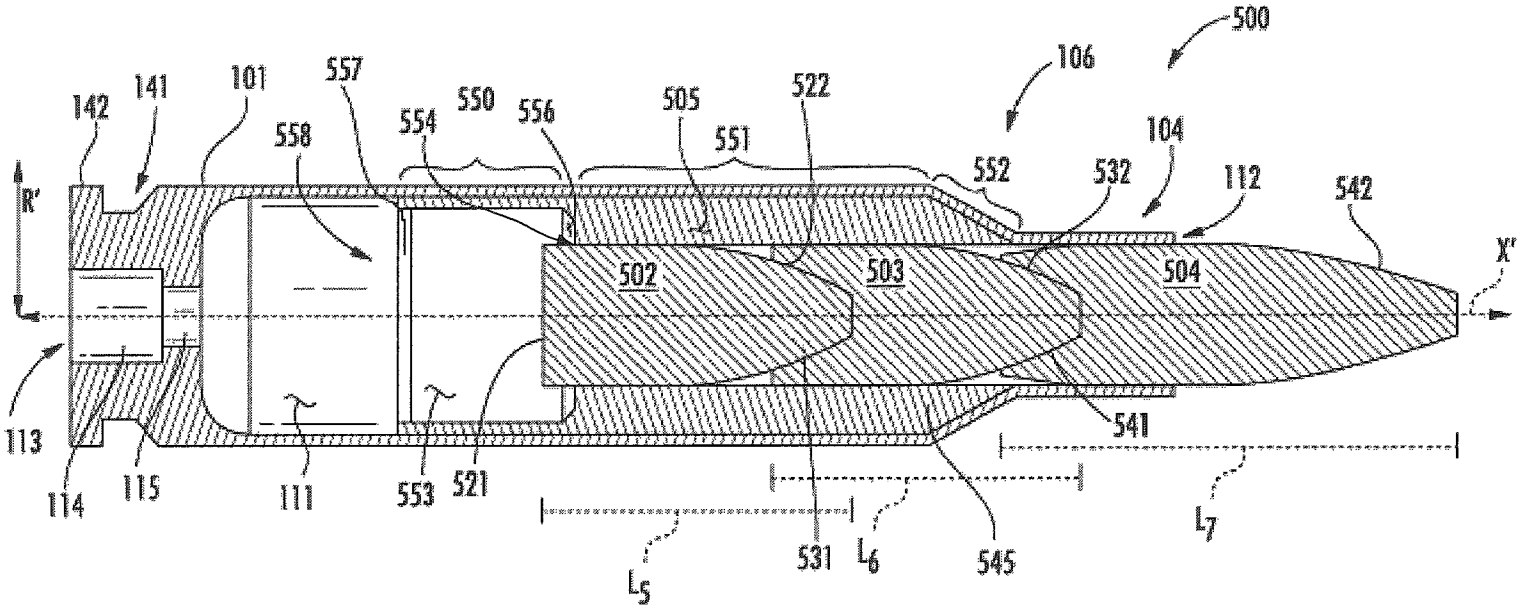
FIG. 5 is a cross section view of a multiple projectile fixed cartridge, according to an additional embodiment of the disclosure.
Figure 6:
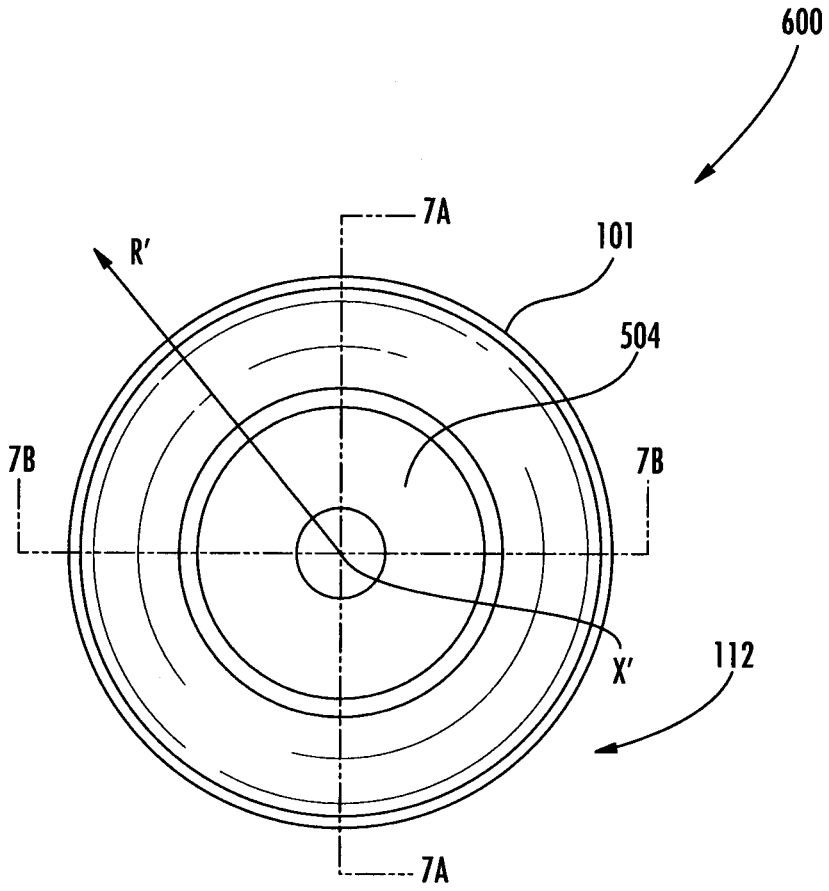
FIG. 6 is an elevation view of the projectile receiving portion of the cartridge.

FIG. 5 is a cross section view of a multiple projectile fixed cartridge 500, according to an additional embodiment of the disclosure. The cartridge 500 may include some substantially similar components as the cartridges 100, 200, 300, 400, with like reference numerals representing like elements. As shown, the cartridge 500 includes the casing 101 and projectiles 502, 503, and 504 arranged therein. The casing 101 is a cylindrical casing having a central axis X' and a radial axis R'. The neck portion 104 may be crimped or otherwise constrained about the projectile 504. In this manner, the neck portion 104 supports the projectile 504 and maintains a collinear alignment of a central axis of the projectile 504 and the central axis X'. The cartridge 100 further includes a retention insert 505 arranged therein and configured to support and align projectiles 502, 503. In this manner, the insert 505 supports the projectiles 502, 503 and maintains a collinear alignment of a central axis of the projectile 502, the central axis of the projectile 503, the central axis of the projectile 504, and the central axis X'.

According to one embodiment, the projectile 502 may be a generally cylindrical projectile having a rear portion 521 and a front portion 522. The projectile 503 may be a generally cylindrical projectile having a rear portion 531 and a front portion 532. The rear portion 531 of the projectile 503 may be shaped, configured, or otherwise manipulated to receive and support the front portion 522. The rear portion 521 may be similarly shaped or configured so as to facilitate receipt of an additional projectile arranged rearward therefrom. The projectile 504 may be a generally cylindrical projectile having a rear portion 541 and a front portion 542. The rear portion 541 may be shaped or configured to receive and support the front portion 532. Thus, the projectiles 502, 503, 504 may be mounted/located along the casing in a generally nested configuration. The projectile 502 may have a total length L5, the projectile 503 may have a total length L6, and the projectile 504 may have a total length L7. The length L5 may be substantially equal to the length L6 in one embodiment. The lengths L5 & L6 may be greater than shorter than, or substantially equal to the length L7. The projectiles 502, 503, 504 may be otherwise shaped or configured without departing from the scope of this disclosure.

The casing 101 further includes a projectile receiving portion 112 configured to receive the projectiles 502, 503, 504, and the insert 505.

As illustrated, the retention insert 505 is arranged within the cavity 111 and abutted against the shoulder portion 106. Therefore, the retention insert 505 is configured to engage an interior surface of the casing and prevent longitudinal movement relative thereto. For example, the retention insert 505 may include an elongated body 545 having a frustoconical section 552 shaped to engage the shoulder portion 106 from an interior of the casing 101. The insert body 545 may further include a first or forward tapered cylindrical portion 551 proximate the frustoconical portion 552, arranged to align and support the projectiles 502, 503 within a cavity 554 formed within the tapered cylindrical portion 551. The cavity 554 may have a geometry that is supportive, or generally supportive, of the exterior dimensions of the projectiles 502, 503. As further illustrated, the projectiles 502, 503 are generally supported in a radial direction within the cylindrical portion 551.

The body 545 of the insert 505 may further include a rearwardly extending skirted or second cylindrical formation 550. The formation 550 may be a hollow section and/or may support a secondary supportive. The formation 550 can include an outer side wall 553 with a first beveled surface 556 proximate the tapered cylindrical portion 551 of the body 545 and a second or rearward surface 557 proximate a distal end 558 of the formation 550 and which also can be formed as a beveled surface. The beveled surfaces 556, 557 of the formation 550 are arranged to receive and guide energy from expanding combustion gases formed from ignition of the propellant in cavity 111 to the projectiles 502, 503, 504 and thereby discharge the projectiles 502, 503, 504 out of the casing and along the barrel of a firearm. The retention insert 505 may be formed of the same or somewhat similar materials as those listed above with reference to the inserts 105, 305. The retention insert 505, and associated features 550, 551, 552, 553, 554, 556, 557, 558 thereof may be otherwise shaped or arranged without departing from the scope of this disclosure.

As described above, the multiple projectile fixed cartridge may include a casing, a retention insert arranged in the casing, and a plurality of projectiles arranged proximate and within the retention insert or casing, wherein the retention insert is configured to align and support two or more projectiles (e.g., 502, 503) of the plurality of projectiles, and the casing is configured to align and support an additional projectile (e.g., 504) of the plurality of projectiles.

The insert may additionally be configured to receive, transmit, and direct combustion gases, for example, as illustrated in FIGS. 6-7.

Figure 7A:
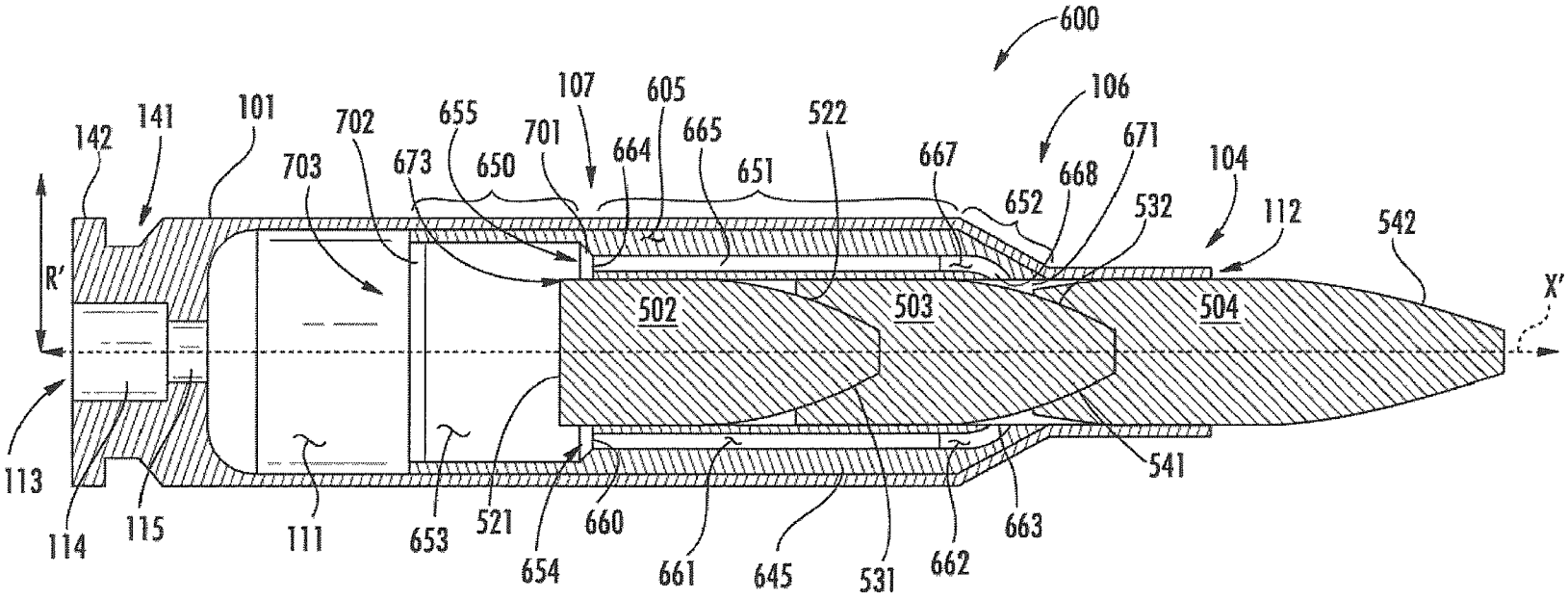
FIG. 7A is a first cross section view of the multiple projectile fixed cartridge of FIG. 6.
Figure 7B:
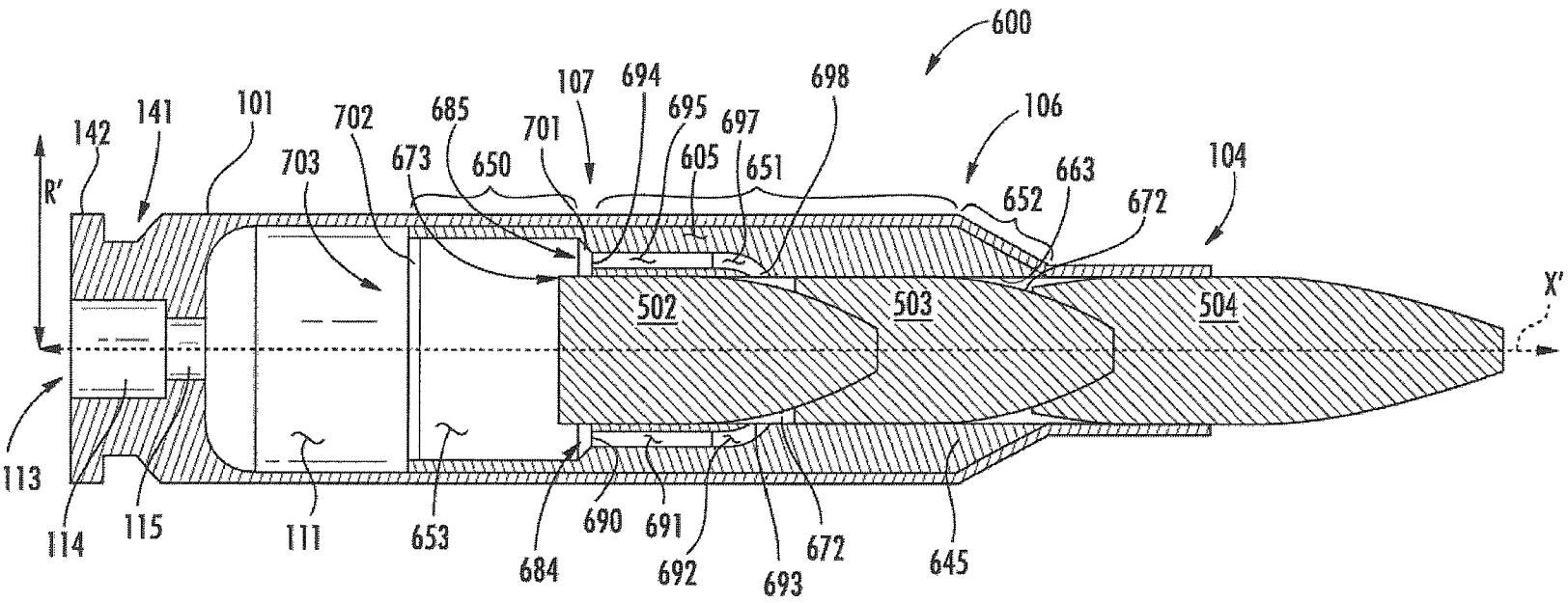
FIG. 7B is a second cross section view of the multiple projectile fixed cartridge of FIG. 6.

FIG. 6 is an elevation view of the projectile receiving portion of the cartridge 112 of a multiple projectile fixed cartridge 600, according to still another embodiment of the disclosure, and FIGS. 7A-7B are cross-sectional views of the multiple projectile fixed cartridge 600. The cartridge 600 may include some substantially similar components as the cartridges 100, 200, 300, 400, 500, with like reference numerals representing like elements.

Turning to FIG. 7A, a first cross section view of the multiple projectile fixed cartridge 600 is illustrated. As shown, the cartridge 600 includes the casing 101 and projectiles 502, 503, 504 arranged therein. The casing 101 is a cylindrical casing having a central axis X' and a radial axis R'. The neck portion 104 may be crimped or otherwise constrained about the projectile 504 as described above. The cartridge 600 further includes a retention insert 605 arranged therein and configured to support and align projectiles 502, 503. In this manner, the insert 605 supports the projectiles 502, 503 and maintains a collinear alignment of a central axis of the projectile 502, the central axis of the projectile 503, the central axis of the projectile 504, and the central axis X'.

As illustrated, the retention insert 605 is arranged within the cavity 111 and abutted against the shoulder portion 106. Therefore, the retention insert 605 is configured to engage an interior surface of the casing and prevent longitudinal movement relative thereto. For example, the retention insert 605 may include an elongated body 645 having a frustoconical section 652 shaped to engage the shoulder portion 106 from an interior of the casing 101. The insert body 645 may further include a tapered cylindrical portion 651 proximate the frustoconical portion 652, arranged to align and support the projectiles 502, 503 within a cavity 673 formed within the tapered cylindrical portion 651. The cavity 673 may have a geometry that is supportive, or generally supportive, of the exterior dimensions of the projectiles 502, 503. As further illustrated, the projectiles 502, 503 are generally supported in a radial direction within the tapered cylindrical portion 651.

The insert body 645 may further include a rearwardly extending skirted or second cylindrical formation 650. The formation 650 may be a hollow section and/or may support a secondary supportive insert. The formation 650 can include an outer side wall 653 having a first or forward beveled surface 701 proximate the tapered cylindrical portion 651 and a second or rearward surface 702 proximate a distal end 703 of the formation 650 and which also can be formed as a beveled surface. The beveled surfaces 701, 702 of the formation 650 are arranged to receive and guide energy from expanding combustion gases formed from ignition of the propellant in cavity 111 to the projectiles 502, 503, 504 and thereby discharge the projectiles out of the casing and along the barrel of a firearm.

As further illustrated, the retention insert 605 may include combustion ports 654, 655 arranged to transmit expanding combustion gases formed from ignition of the propellant chemistry arranged in cavity 111 to a space 671 between projectiles 503, 504.

The combustion port 654 may include an inlet 660 arranged on the first beveled surface 701, a longitudinal section 661 in communication with the inlet 660, a curved or angled section 662 in communication with the longitudinal section 661, and an exhaust 663 in communication with the curved section 662 and the space 671. The longitudinal section 661 may extend in a longitudinal direction from the inlet 660 to the curved section 662. The curved section 662 may curve radially towards the exhaust 663. Thus, the inlet 660 may receive expanding combustion gases, the longitudinal section 661 may transmit the received gases, and the curved section 662 may direct the transmitted gases to the exhaust 663 such that the expanding gases may at least partially fill the space 671.

The combustion port 655 may include an inlet 664 also arranged on the first beveled surface 701, a longitudinal section 665 in communication with the inlet 664, a curved or angled section 667 in communication with the longitudinal section 665, and an exhaust 668 in communication with the curved section 667 and the space 671. The longitudinal section 665 may extend in a longitudinal direction from the inlet 664 to the curved section 667. The curved section 667 may curve radially towards the exhaust 668. Thus, the inlet 664 may receive expanding combustion gases, the longitudinal section 665 may transmit the received gases, and the curved section 667 may direct the transmitted gases to the exhaust 668 such that the expanding gases may at least partially fill the space 671.

In addition to the ports 645, 655, the cartridge 600 may include additional ports to aid in directing expanding combustion gases to a space 672 between projectiles 502, 503 as illustrated in FIG. 7B. As shown in FIG. 7B, the retention insert 605 may include combustion ports 684, 685 arranged to transmit expanding combustion gases formed from ignition of the propellant chemistry arranged in cavity 111 to a space 672 between projectiles 502, 503.

The combustion port 684 may include an inlet 690 arranged on the first beveled surface 701, a longitudinal section 691 in communication with the inlet 690, a curved or angled section 692 in communication with the longitudinal section 691, and an exhaust 693 in communication with the curved section 692 and the space 672. The longitudinal section 691 may extend in a longitudinal direction from the inlet 690 to the curved section 692. The curved section 692 may curve radially towards the exhaust 693. Thus, the inlet 690 may receive expanding combustion gases, the longitudinal section 691 may transmit the received gases, and the curved section 692 may direct the transmitted gases to the exhaust 693 such that the expanding gases may at least partially fill the space 672.

The combustion port 685 may include an inlet 694 also arranged on the first beveled surface 701, a longitudinal section 695 in communication with the inlet 694, a curved or angled section 697 in communication with the longitudinal section 695, and an exhaust 698 in communication with the curved section 697 and the space 672. The longitudinal section 695 may extend in a longitudinal direction from the inlet 694 to the curved section 697. The curved section 697 may curve radially towards the exhaust 698. Thus, the inlet 694 may receive expanding combustion gases, the longitudinal section 695 may transmit the received gases, and the curved section 697 may direct the transmitted gases to the exhaust 698 such that the expanding gases may at least partially fill the space 672.

The energy of the expanding combustion gases transmitted through the formation 650 and the ports 654, 655, 684, 685 may thereby discharge the projectiles 502, 503, 504 out of the projectile receiving portion 112 and into a weapon which further directs the projectiles 502, 503, 504. The retention insert 605 may be formed of the same or somewhat similar materials as those listed above with reference to the inserts 105, 305, 505. The retention insert 605, and associated features 650, 651, 652, 653, 654, 655, 660, 661, 662, 663, 664, 665, 667, 668, 684, 685, 690, 691, 692, 693, 694, 695, 697, 698, 701, 702, 703 may be otherwise shaped or arranged without departing from the scope of this disclosure.

As described above, a multiple projectile fixed cartridge may include a casing, a retention insert arranged in the casing, and a plurality of projectiles arranged proximate and within the retention insert or casing, wherein the retention insert is configured to align and support two or more projectiles (e.g., 502, 503) of the plurality of projectiles, and the casing is configured to align and support an additional projectile (e.g., 504) of the plurality of projectiles. The retention insert may include one or more ports (e.g., 654, 655, 684, 685) arranged to receive, transmit, route, and direct expanding combustion gases to individual projectiles (e.g., 503, 504) or a space between one or more projectiles (e.g., 671, 672).

Hereinafter, a brief description of the manufacture of multiple projectile fixed cartridges is provided with reference to FIG. 8.

Figure 8:
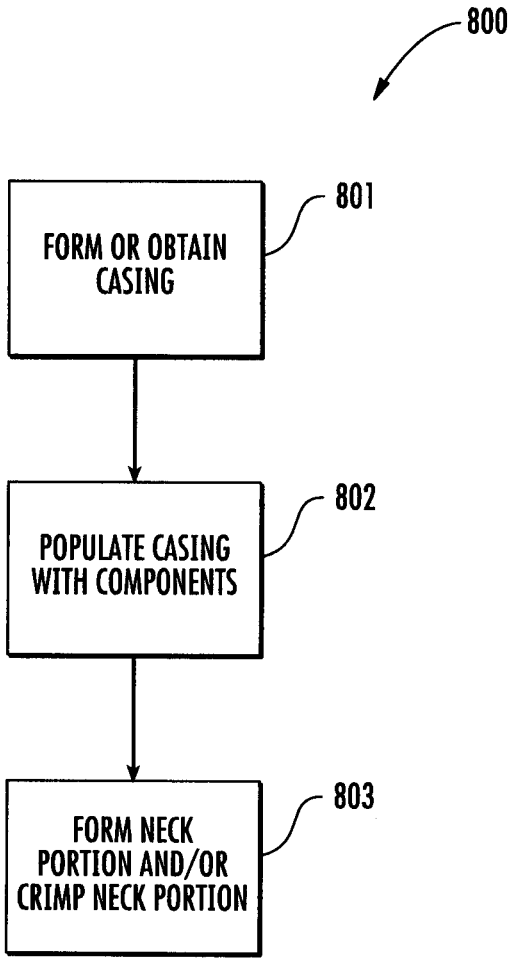
FIG. 8 is a flowchart of a method of manufacturing a multiple projectile fixed cartridge, according to embodiments of the disclosure.

FIG. 8 is a flowchart of a method 800 of manufacturing a multiple projectile fixed cartridge, according to embodiments of the disclosure. The method 800 may include forming or obtaining a casing for forming a cartridge as indicated at block 801. The forming operation may include casting, milling, cleaning, drawing, and/or other methods for forming a suitable material into a casing. The formed or obtained casing may be substantially similar to casing 101, or may include or omit one or more features described herein.

The method 800 further includes populating the casing with cartridge components at block 802, which may include, at least, pressing a primer into a primer receiving portion of the formed casing, inserting a propellant charge into a central cavity of the casing, inserting the retention insert into the casing, and inserting a plurality of projectiles into the retention insert and/or casing. Inserting the retention insert may occur after insertion of projectiles into the retention insert, or may occur in reverse according to some embodiments.

The method 800 further includes forming a neck portion and/or crimping a neck portion about a single projectile of the plurality of projectiles at block 803. Forming the neck portion may occur after insertion of the retention insert but before insertion of the projectiles according to some embodiments. Thereafter, the neck portion may be crimped or otherwise engaged to constrain a neck portion of the casing about a projectile of the plurality of projectiles.

While the invention has been described in terms of exemplary embodiments, those skilled in the art will recognize that the invention can be practiced with modifications in the spirit and scope of the appended claims. The examples given above are merely illustrative and are not meant to be an exhaustive list of all possible designs, embodiments, applications, or modifications of the invention.

What is claimed is:

1. A multiple projectile cartridge, comprising:

a casing;

a retention insert arranged in the casing, the retention insert comprising a body having one or more sections, and defining a cavity extending longitudinally thereal-long; and a plurality of projectiles arranged in an end-to-end alignment, with at least one projectile received within and supported by the retention insert;

wherein the body of the retention insert is configured to receive and support at least a first projectile of the plurality of projectiles in alignment with at least a second projectile of the plurality of projectiles, the cavity defined by the body of the retention insert being configured to support a portion of an exterior shape of the first projectile, wherein the casing is configured to align and support the second projectile of the plurality of projectiles, and wherein the retention insert is configured to restrain radial movement of the first projectile relative to the casing and the second projectile.

2. The cartridge of claim 1, wherein a central axis of the casing, a central axis of the first projectile, and a central axis of the second projectile are collinear.

3. The cartridge of claim 1, wherein the body of the retention insert comprises:

a first section and a second section with a transition area defined therebetween; and wherein the cavity is defined along the second section of the body.

4. The cartridge of claim 1, wherein the casing comprises:

a neck portion configured to align and support the second projectile;

a shoulder portion arranged proximate the neck portion; and a cylindrical body arranged proximate the shoulder portion and defining a chamber therealong.

5. The cartridge of claim 4, wherein the retention insert comprises a body having a frustoconical section configured to engage the shoulder portion from an interior of the casing, a cylindrical portion proximate the frustoconical portion and projecting rearwardly along the chamber of the cylindrical body of the casing, and a cavity defined substantially centrally along the cylindrical portion, the cavity adapted to receive and support the first projectile within the retention insert in a position substantially longitudinally aligned with the second projectile.

6. The cartridge of claim 1, wherein:

the casing comprises a neck portion configured to receive and support the second projectile, and a shoulder portion arranged proximate the neck portion; and wherein the retention insert comprises a cylindrical portion arranged in abutting contact with the shoulder portion of the casing and having a cavity formed therealong and configured to receive and support the first projectile in alignment with the second projectile.

7. The cartridge of claim 1, wherein the casing further comprises:

a chamber configured to receive the plurality of projectiles, the retention insert, and a propellant charge;

a primer receiving portion proximate the chamber and configured to receive a primer;

a primer discharge port extending between the primer receiving portion and the chamber for transmitting energy from the primer into the chamber for igniting the propellant.

8. The cartridge of claim 1, wherein the retention insert comprises a body with at least one combustion port extending forwardly therefrom configured to transmit expanding combustion gases from a propellant chemistry to a location adjacent the first and second projectiles.

9. The cartridge of claim 1, wherein the casing comprises an interior cavity, and the retention insert comprises at least one combustion port in communication with the interior cavity and a space between the first and second projectiles.

10. The cartridge of claim 9, wherein the at least one combustion port comprises:

an inlet in communication with the interior cavity;

a longitudinally extending section in communication with the inlet;

an inwardly directed section in communication with the longitudinally extending section and having an exhaust opening directed toward the space between the first and second projectiles.

11. A multiple projectile cartridge, comprising:

a casing including a body defining an interior chamber, and a neck portion;

a series of projectiles arranged in an end-to-end abutting alignment with a central axis of each of the series of projectiles being substantially collinear; and a retention insert at least partially disposed within the interior chamber of the casing, the retention insert including an insert body having one or more sections and a cavity extending longitudinally therealong, wherein a first one of the series of projectiles is at least partially received within the cavity of the insert so that the insert at least partially supports the first projectile within the interior chamber of the casing, wherein the neck portion of the casing engages at least a portion of an exterior surface of a second one of the series of projectiles so as to align and support the second one of the series of projectiles, and wherein the retention insert substantially maintains the first one of the series of projectiles in a position spaced from an interior surface of the interior chamber of the body of the casing and restrains radial movement of the first projectile relative to the casing and the second one of the series of projectiles.

12. The multiple projectile cartridge of claim 11, wherein the insert body comprises a first section and a second section with a transition area defined therebetween, and wherein the cavity of the insert body is defined along the second section of the insert body.

13. The multiple projectile cartridge of claim 12, wherein the casing further includes a shoulder portion arranged proximate the neck portion, and wherein the retention insert comprises a body having a frustoconical section positioned so as to engage the shoulder portion, and a cylindrical portion proximate the frustoconical portion and extending rearwardly along the cylindrical body of the casing.

14. The multiple projectile cartridge of claim 11, wherein the series of projectiles creates an increased total mass that reduces a velocity of discharge of the projectiles sufficient to provide subsonic flight thereof.

15. The multiple projectile cartridge of claim 11, wherein the interior chamber of the casing receives a propellant charge, and the casing further comprises a primer receiving portion proximate the interior chamber and configured to receive a primer, and a primer discharge port extending between the primer receiving portion and the chamber for transmitting energy from the primer into the chamber for igniting the propellant charge.

* * * * *